US010946262B2

(12) United States Patent
Bush, III

(10) Patent No.: US 10,946,262 B2
(45) Date of Patent: Mar. 16, 2021

(54) GOLF TRAINING AID

(71) Applicant: Tony Bush, III, San Francisco, CA (US)

(72) Inventor: Tony Bush, III, San Francisco, CA (US)

( * ) Notice: Subject to any disclaimer, the term of this patent is extended or adjusted under 35 U.S.C. 154(b) by 0 days.

(21) Appl. No.: 16/872,247

(22) Filed: May 11, 2020

(65) Prior Publication Data

US 2020/0269118 A1 Aug. 27, 2020

Related U.S. Application Data

(60) Provisional application No. 62/920,621, filed on May 9, 2019.

(51) Int. Cl.
*A63B 69/36* (2006.01)

(52) U.S. Cl.
CPC ..... *A63B 69/3632* (2013.01)

(58) Field of Classification Search
CPC . A63B 69/3632; A63B 69/3635; A63B 60/00; A63B 60/04; A63B 60/24; A63B 2071/0625; A63B 15/005; A63B 2069/0008; A63B 2209/08; A63B 60/16; A63B 60/42; A63B 69/0002; A63B 2053/0495; A63B 2071/0655; A63B 60/10; A63B 69/36
See application file for complete search history.

(56) References Cited

U.S. PATENT DOCUMENTS 1,676,270 A * 7/1928 Mattison ..... A63B 69/3635 473/234
3,156,211 A * 11/1964 Mallory, Jr. ..... A63B 69/3608 473/211
4,027,886 A * 6/1977 Katsube ..... A63B 69/3632 473/234
5,082,279 A * 1/1992 Hull ..... A63B 53/00 473/242
5,634,856 A * 6/1997 Rainey ..... A63B 60/04 473/234
5,803,829 A * 9/1998 Hayashi ..... A63B 53/00 473/326
6,500,074 B1 * 12/2002 Thacker ..... A63B 69/3632 473/234
7,857,707 B2 * 12/2010 Beppu ..... A63B 53/00 473/256
9,579,557 B1 * 2/2017 Molinelli ..... A63B 69/0026
(Continued)

*Primary Examiner* — Nini F Legesse
(74) *Attorney, Agent, or Firm* — Steven A. Nielsen; www.NielsenPatents.com

(57) ABSTRACT

A golf training aid may appear to take the form of a golf club, sometimes without a club head. At a proximal end, or end near the golfer, the training aid may comprise a standard golf grip attached to a carbon fiber cylinder portion, the cylinder portion containing a magnet, with a rubber seat disposed upon the magnet. A metallic ball bearing may be in magnetic attachment the magnet. A plurality of additional ball bearings, smaller than the metallic ball bearing, may be magnetically retained and distal to metallic ball bearing. The ball bearings may be disposed within a laminated polycarbonate tube. A far end or distal end of the training aid may comprise a rubber plug to contain ball bearings that have traveled down the tube, optional weights and a magnetic end cap.

5 Claims, 8 Drawing Sheets

(56) References Cited

U.S. PATENT DOCUMENTS

| | | | | |
|---|---|---|---|---|
| 2004/0009824 | A1* | 1/2004 | Shaw | A63B 53/00 473/226 |
| 2005/0192112 | A1* | 9/2005 | Kim | A63B 69/36 473/224 |
| 2016/0243420 | A1* | 8/2016 | Rambo | A63B 69/0002 |

* cited by examiner

GOLF TRAINING AID

RELATED PATENT APPLICATION AND INCORPORATION BY REFERENCE

This is a utility application based upon U.S. patent application Ser. No. 62/920,621 filed on or about May 9, 2019. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION

(1) Field of the Invention

The invention generally relates to golf swing training aids. More particularly, the invention relates to the use of hollow golf club like structure with a magnet at the end proximal to the golfer with ball bearings breaking the magnetic connection upon execution of a desired swing, releasing the ball bearings to move to the distal end of the training aid.

(2) Description of the Related Art

Other swing golf aids are known in the related art. For example weighted golf clubs are a known golf aid. But the known related art fails to provide objects in motion internal to a golf aid, giving visual, sound and physical impact feedback upon a proper golf swing, these being enclosed in a protective chamber. Thus, there is a need in the art for the presently disclosed embodiments.

BRIEF SUMMARY OF THE INVENTION

The present invention overcomes shortfalls in the related art by presenting an unobvious and unique combination, configuration and use of magnets, ball bearings, magnet pads and other components to provide tactile and sound reactions triggered by execution of a desired golf swing, protected inside a clear chamber that does not require physical contact to activate or reset. Additionally, the disclosed embodiments overcome shortfalls in the related art by efficiently incorporating interchangeable weights at the distal end and a pin for angled club ground insertion, with the pin disposed in the proximal end.

The disclosed embodiments include a golf training aid that combines multiple functionalities into (1) durable, light weight and easy to carry (tournament legal in a golf bag) device. Everyone should warm up before they engage in any physically challenging activity. With golf, many players will use a weighted club which has limited benefits; warming up with a weighted club alone does not give you any real indication as to the proper technique. With the disclosed unique and unobvious combination of a magnetically controlled alloy steel ball in concert with HDPE pellets, the disclosed embodiments may give one audible, physical and visual feedback so that while warming up, a player can also hear, see and feel a good swing. The HDPE pellets provide a pleasing "swoosh" when activated by the movement of the device (similar to that of a hoola-hoop). In addition to providing audible feedback, the pellets also serve to attenuate the impact of the magnetically controlled ball bearing striking the distal end of the device.

Regarding the main ball bearing; a magnet inside the grip end or proximal end of the device holds the ball bearing with just the right amount of force to release early if a player "casts" from the top of the swing. If the timing is correct, the magnetically controlled ball bearing has just the right amount of force to release just after the impact position, providing a pleasing sound upon impact with the help of the HDPE pellets. All of these components are protected inside a clear, laminated polycarbonate tube for years of functional use.

Regarding the very popular "overspeed training" applied to golf, the disclosed embodiments also excel. The prior art requires the use of multiple clubs to produce varying weights. These too fall short of the disclosed embodiments' functionality as they give no real feedback. The disclosed embodiments may enable overspeed training with the use of just one club with interchangeable weights. This allows one to quickly and easily work through any overspeed training routine by adding/removing the interchangeable weights (which can be easily stored in your pocket when working down to a lighter weight). The combination of weights allows one to swing heavy (warming up), medium, light and super-light to develop faster club head speed.

In addition, one or more disclosed embodiments may be just 1" in diameter and 45" long which enables a disclosed training aid to be easily carried in a standard golf bag. Its light weight and multiple training uses make it an easy addition to the on-course and at-home training routine for golfers of all levels.

The known related art fails to disclose, suggest or teach the use of the disclosed.

BRIEF DESCRIPTION OF THE DRAWINGS

FIGS. 5A to 6C depict various stages of end cap use and the internal weights.

FIGS. 6A to 6C depict various positions of addressing a golf ball

REFERENCE NUMERALS IN THE DRAWINGS

Figure 1:
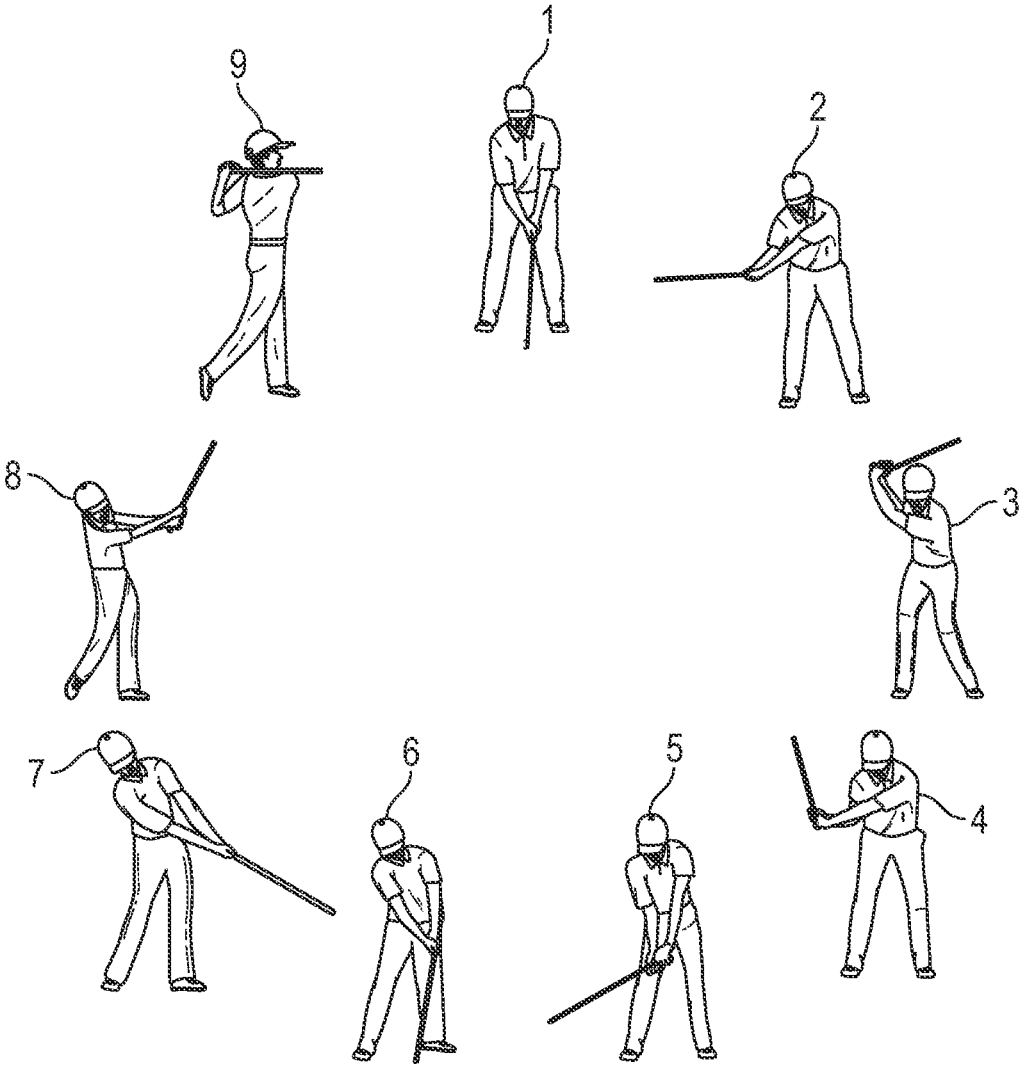
FIG. 1 depicts use of a disclosed golf swing training aid

1 address position
2 nine o'clock position
3 top of backswing position
4 slot position
5 roll position
6 impact zone

7 straight line release
8 forearm rotation
9 finish position
100 a disclosed embodiment in general
200 standard golf grip system
250 tube to fit golf grip
300 tube
310 distal end of tube
315 proximal end of tube
350 proximal magnet
370 weight void defined within tube, distal side of distal barrier 400 and inside surface of end cap 700
380 an interchangeable weight, sometimes contained within the weight void
400 distal barrier/pad/stopper
450 proximal barrier/pad/stopper
500 proximal handle magnet
600 main ball bearing
650 sub bearings/pellets/HDPE pellets
700 end cap assembly or end cap
720 end cap magnet
740 spherical surface of end cap
750 pin void defined within spherical surface of end cap
800 pin These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The term "SlingShot" may sometimes be used to refer to a disclosed embodiment.

Referring to FIG. 1, nine or so positions of use are shown. Uses for the disclosed embodiments may include the following directions, which comport to each numbered position in FIG. 1.

1. Take your address position, hovering the SlingShot a few inches above the ground.
2. Slowly swing it back to 9 o'clock to feel a full extension as shown
3. Slowly continue to the TOP of your backswing, allowing the balls to roll to the handle
4. Slowly shift your weight onto your lead foot, then DROP the handle into the "slot" as shown, retaining the weight in the handle as long as you can to create lag
5. ROLL the balls into impact
6. Allow the momentum of the SlingShot to pull your hands through the impact zone
7. Feel the straight line release by extending down your target line through impact
8. Allow the momentum of the SlingShot to create proper forearm rotation as shown
9. Allow the SlingShot to release into a full, balanced finish, hold and repeat Referring to FIG. 2, a sectional view of a disclosed embodiment 100 may comprise an end cap assembly 700 or end cap, with the end cap comprising an end cap magnet 720 and a spherical surface 740, with the spherical surface sometimes defining a pin void. The end cap may also comprise one or more internal weights or be comprised of mass sufficient to be considered weight for purposes of golf swing training. The end cap may be in threaded attachment to a distal end of the tube 300. The tube may be made of transparent polycarbonate or similar material.

A weight void 370 may be defined within the tube 300, a distal side of the distal barrier 400 and an inside surface or magnet area of the end cap 700. The weight void may accommodate or contain one or two weights. In a one weight configuration, the end cap magnet 720 may retain the single weight to keep the single weight stationary. When two weights are contained within the weight void, the two weights may remain relatively stationary during a swing.

The weight void or weight camber provides advantages over the prior art in allowing for four swing speeds or four different weighted swings. The four swing configurations may comprise two weights secured by the end cap; one weight and use of the end cap, just the end cap and the forth configuration devoid of the end cap. Thus, four different swing weights are achieved.

Figure 2:
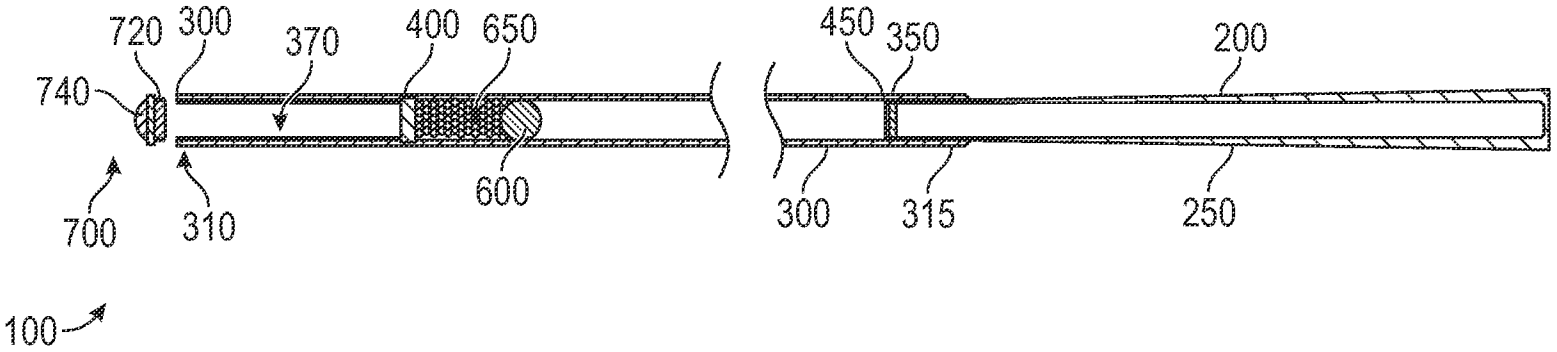
FIG. 2 depicts a sectional view of a disclosed golf swing training aid

FIG. 2 shows the pellets 650 against the proximal side of the distal barrier, with the main ball bearing 600 against the pellets. The illustrated positions of the pellets and main ball bearing are consistent with the implement being in a downward position. When the implement is in an upwardly disposed position, the main ball bearing will rest upon the distal side of the proximal barrier 450, with the proximal magnet retaining the main ball bearing. The pellets will be on the distal side of the main ball bearing.

Figure 3:
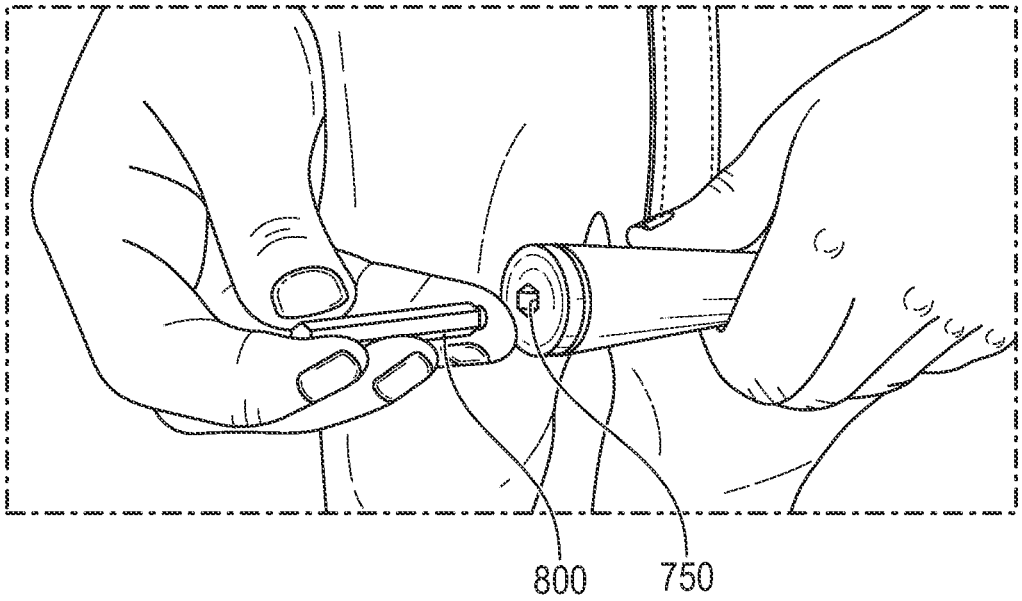
FIG. 3 depicts a pin to be inserted in the handle area

FIG. 3 depicts a pin 800 ready for insertion into a pin void 750.

Figure 4:
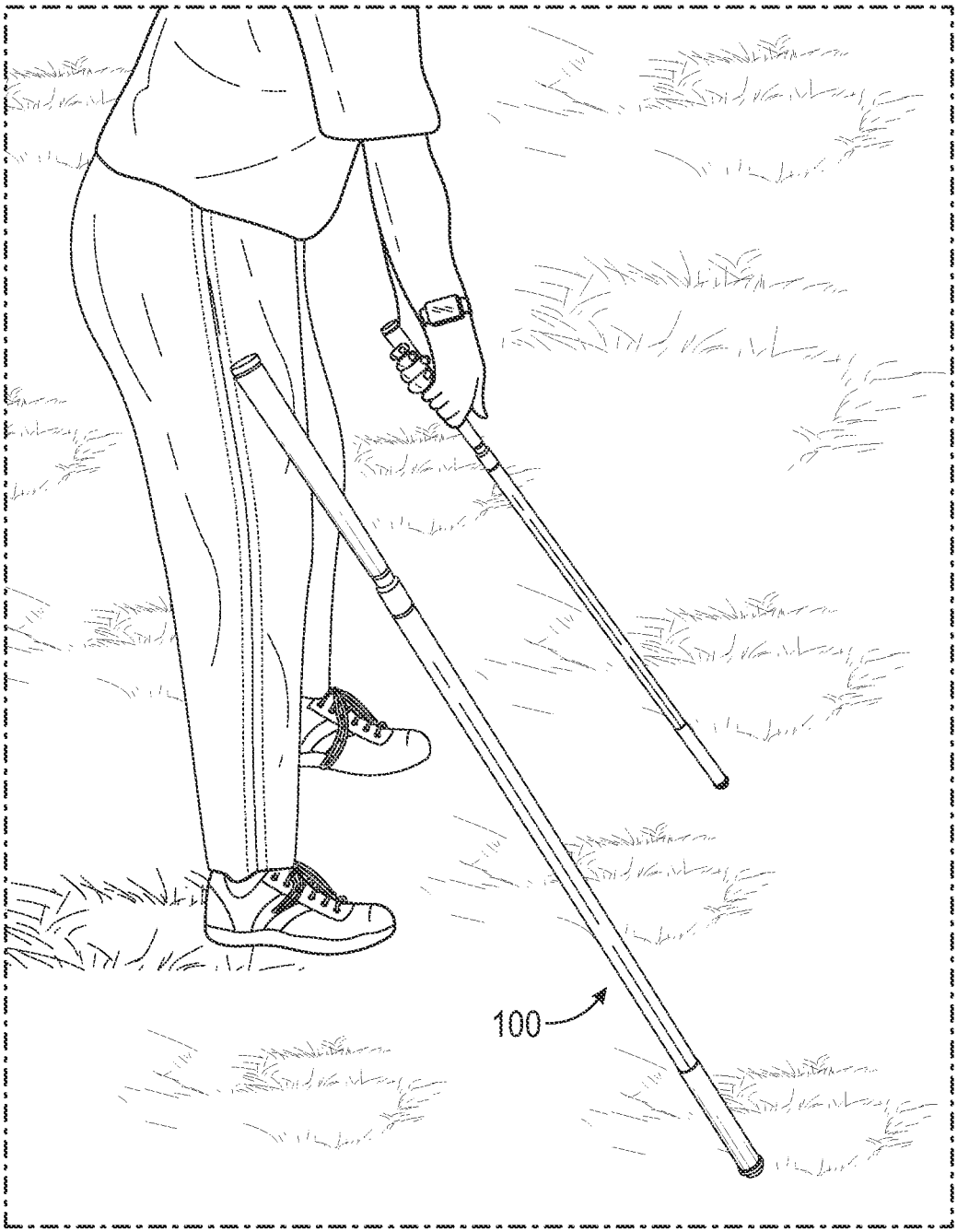
FIG. 4 depicts the use of a pin to retain the device at an angle for use as an angle guide

FIG. 4 depicts a disclosed embodiment placed into the ground at an angle by use of the pin and depicts a golfer using the disclosed embodiment as a swing aid.

Figure 5A:
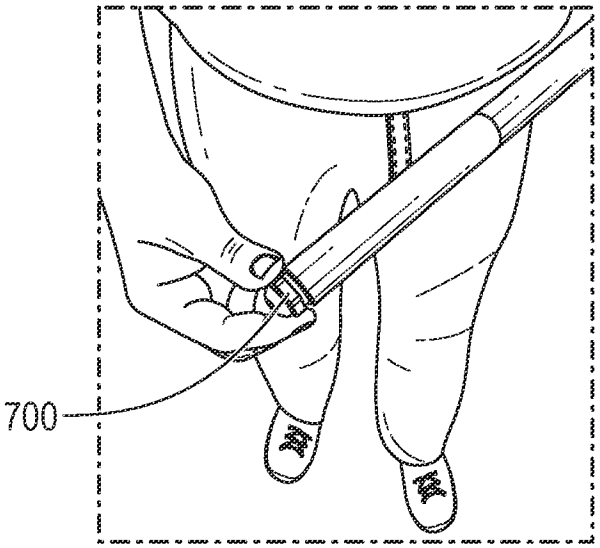
Figure 5B:
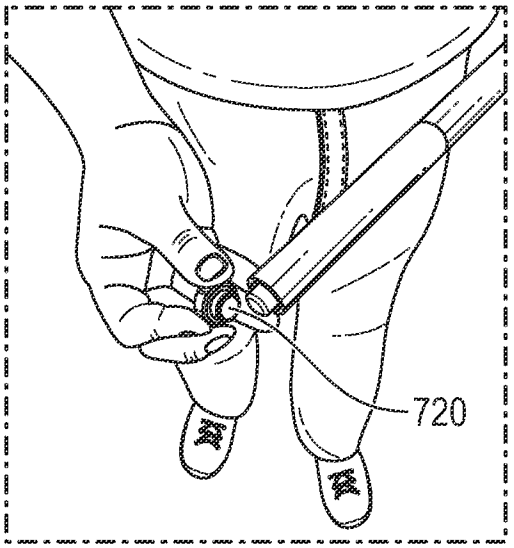
Figure 5C:
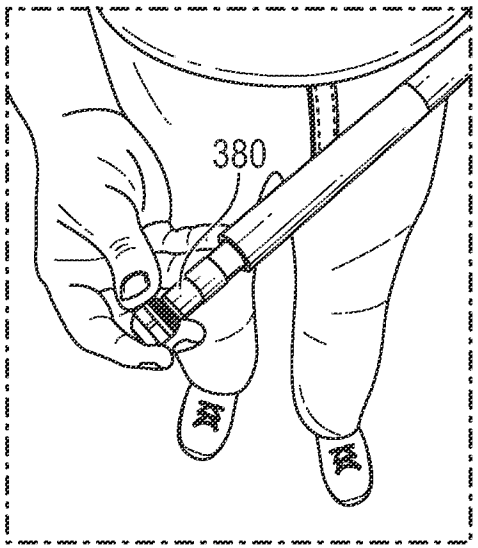

FIGS. 5A to 5C depict various stages of end cap use and the internal weights. FIG. 5A depicts an end cap being removed from a disclosed system. An endcap is being unscrewed to access the interchangeable weighs disposed inside the weigh void at the port or distal end of the device.

FIG. 5B depicts a magnetic end cap that prevents the weights from rattling inside the weight port.

FIG. 5C shows one of the weights 380 in magnetic connection with an endcap.

Figure 6C:
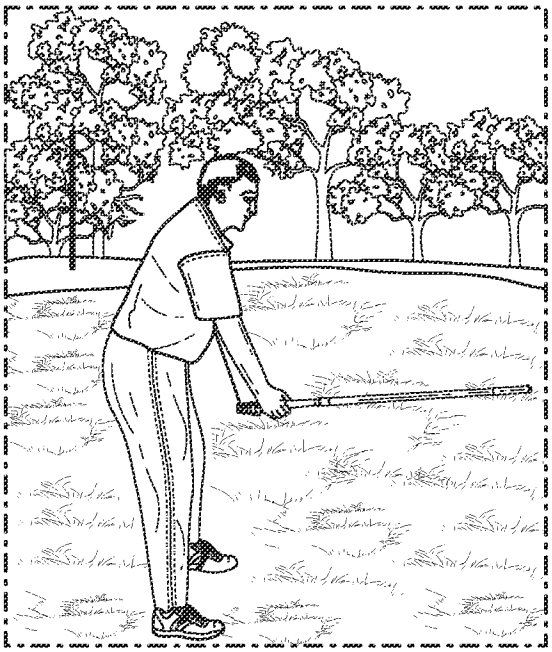
Figure 6B:
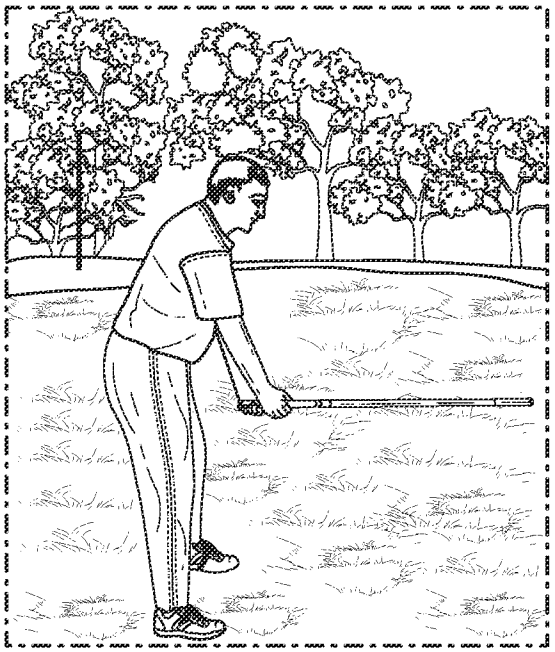
Figure 6A:
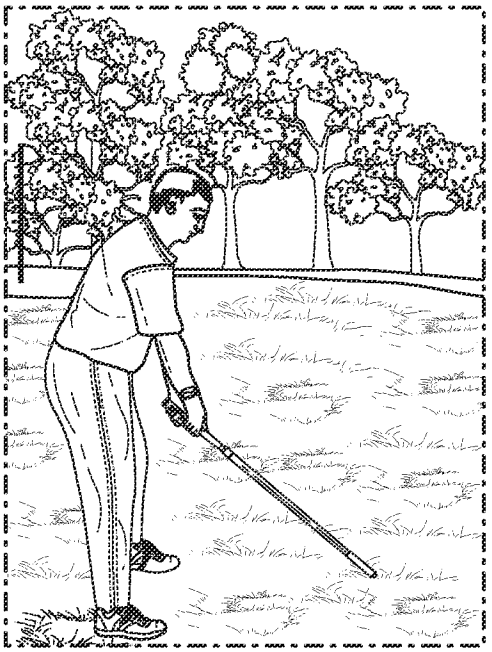

FIGS. 6A to 6C depict various stages of addressing a golf ball using a disclosed embodiment. In FIG. 6A a user will hover the device just above the ground. The ball bearing and pellets are at the distal or club end of the device.

FIG. 6B a user or golfer will raise the end of the device to allow the ball bearing and pellets to roll to the grip end or proximal end.

FIG. 6C this position allows the ball bearings to roll and be secured by the internal magnet at the base of the grip, keeping the ball bearings securely in place through the backswing.

Figure 7C:
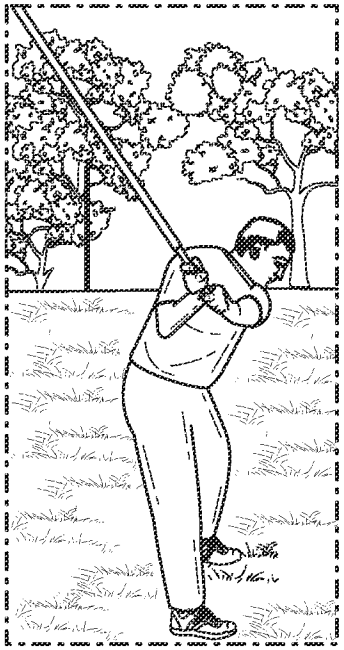
FIGS. 7A to 7C depict various backswing positions
Figure 7B:
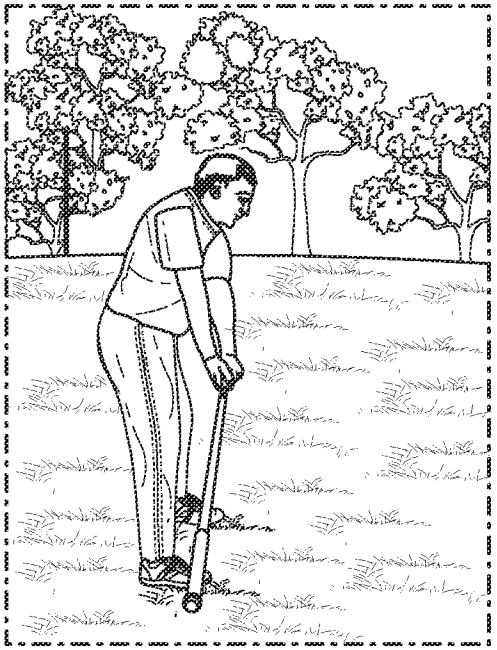
Figure 7A:
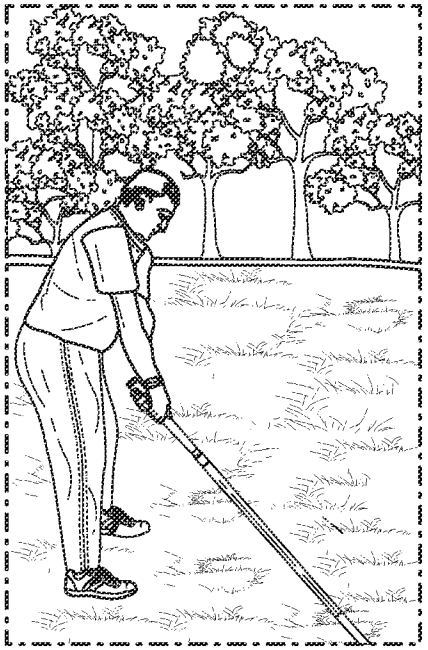

FIGS. 7A to 7C depict various backswing positions. In FIG. 7A a golfer or user may start the back swing with shoulder rotation and light grip, such that the user may feel the weights in hand.

In FIG. 7B, to encourage or train an arm extension in a back swing, the user may keep the pellets in the distal position, as long as possible. If the club is held to steeply, the user will hear and or feel the pellets slide toward the grip end before the hands reach hip eight, indicating a poor backswing.

In FIG. 7C if the user's backswing is correct, the user will hear the pellets slide into the grip end after the user's hands pass their hips. The device is fully loaded, with the pellets in the proximal position.

Figure 8A:
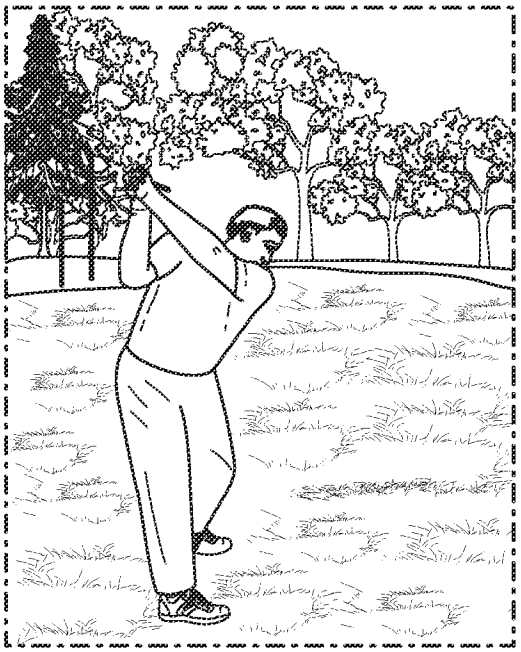
FIGS. 8A to 8C depict various downswing positions
Figure 8B:
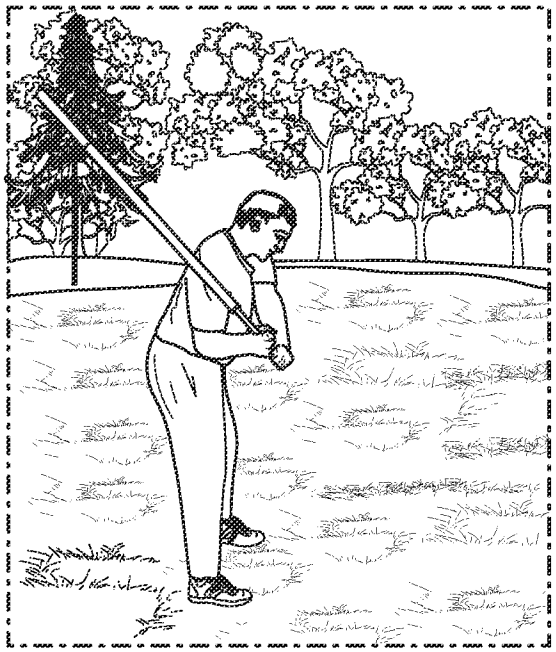
Figure 8C:
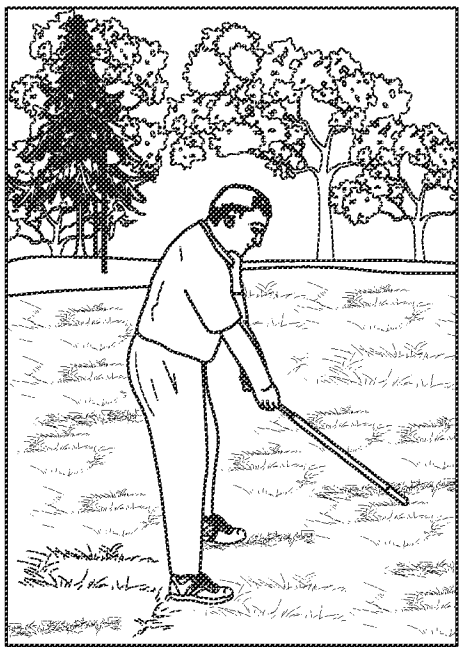

FIGS. 8A to 8C depict various downswing positions. FIG. 8A depicts a top position.

FIG. 8B depicts a drop move or drop position. In instructions for the drop may include: Drop the device down, focus on pointing the grip end at the ground. Try to keep the pellets and bearing in the grip end as long as possible. This movement creates tremendous lag and effortless power. If you case from the top, you will force the ball bearing off its magnetic seat early which will cause you to hear and feel the pellets hit the endo the device before the bottom of your swing.

FIG. 8C depicts a roll position or drop move. Instructions for this stage may include: Roll the pellets and ball bearing into impact. If you have timed your swing correctly, you will see, hear and feel the bearing "thump" just after impact. That's the visual, audile and physical indication of a great swing. Allow the momentum of the ball bearing and internal weights to pull you into a balanced finish, hold and repeat.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

The disclosed embodiments may include the following items:

A golf swing aid (100) comprising:

a tube (300) having a distal end (310) and a proximal end (315), the tube having an endcap assembly (700) disposed at the distal end of the tube, the endcap assembly comprising a magnet;

the tube further comprising a distal barrier (400);

the tube defining a weight void (370) the weight void defined within the tube, a proximal side of the end cap assembly and a distal side of the distal barrier;

the tube further comprising a proximal barrier (450) and a proximal magnet (350); and the tube containing a main ball bearing (600) and a plurality of pellets (650).

2. The golf swing guide of 1 wherein the main ball bearing and the plurality of pellets are disposed within the tube between the distal barrier and proximal barrier.

3. The golf swing guide of 2 wherein the end cap assembly includes distal side that defines a pin void (750).

4. The golf swing guide of 3 wherein a pin (800) is disposed within the pin void.

5. The golf swing guide of 1 further including one or more interchangeable weights (380) disposed within the weight void.

What is claimed is:

1. A golf swing aid (100) comprising:

a) a tube (300) having a distal end (310) and a proximal end (315), the tube having an endcap assembly (700) disposed at the distal end of the tube, the endcap assembly comprising a magnet;

b) the tube further comprising a distal barrier (400);

c) the tube defining a weight void (370) the weight void further defined by the end cap assembly and the distal barrier;

d) the tube further comprising a proximal barrier (450) and a proximal magnet (350); and e) the tube containing a main ball bearing (600) and a plurality of pellets (650).

2. The golf swing guide of claim 1 wherein the main ball bearing and the plurality of pellets are disposed within the tube between the distal barrier and proximal barrier.

3. The golf swing guide of claim 2 wherein the end cap assembly further comprises a spherical surface (740) and the spherical surface defines a pin void (750).

4. The golf swing guide of claim 3 wherein a pin (800) is disposed within the pin void.

5. The golf swing guide of 1 further including one or more interchangeable weights (380) disposed within the weight void.

* * * * *